US007802431B2

(12) United States Patent
Parker

(10) Patent No.: US 7,802,431 B2
(45) Date of Patent: Sep. 28, 2010

(54) COMBUSTOR LINER WITH REVERSE FLOW FOR GAS TURBINE ENGINE

(75) Inventor: David M. Parker, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 1071 days.

(21) Appl. No.: 11/494,175

(22) Filed: Jul. 27, 2006

(65) Prior Publication Data

US 2010/0154426 A1 Jun. 24, 2010

(51) Int. Cl.
*F02C 7/18* (2006.01)
*F23R 3/06* (2006.01)
*F23R 3/08* (2006.01)

(52) U.S. Cl. ..... 60/752; 60/754; 60/757

(58) Field of Classification Search ..... 60/752, 60/755, 756, 757, 758, 759, 760, 754, 39.83
See application file for complete search history.

(56) References Cited

U.S. PATENT DOCUMENTS 3,360,929 A * 1/1968 Drewry ..... 60/760
3,738,106 A * 6/1973 Stein et al. ..... 60/759
4,244,178 A 1/1981 Herman et al.
4,432,207 A * 2/1984 Davis et al. ..... 60/760
4,474,014 A * 10/1984 Markowski ..... 60/760
4,719,748 A 1/1988 Davis, Jr. et al.
4,896,510 A * 1/1990 Foltz ..... 60/757
4,903,477 A 2/1990 Butt
5,201,887 A * 4/1993 Bruchez et al. ..... 60/752
6,282,905 B1 9/2001 Sato et al.
6,334,310 B1 * 1/2002 Sutcu et al. ..... 60/752
6,446,438 B1 * 9/2002 Kraft et al. ..... 60/760
6,837,051 B2 1/2005 Mandai et al.
2002/0088233 A1 * 7/2002 Ohnishi et al. ..... 60/752
2002/0178728 A1 * 12/2002 Mc Caffrey et al. ..... 60/752
2003/0000216 A1 * 1/2003 Akagi et al. ..... 60/752
2005/0144953 A1 * 7/2005 Martling et al. ..... 60/752
2005/0262844 A1 * 12/2005 Green et al. ..... 60/752
2006/0032235 A1 * 2/2006 Aumont et al. ..... 60/752
2007/0012043 A1 * 1/2007 Parker et al. ..... 60/752

* cited by examiner

*Primary Examiner*—Ted Kim

(57) ABSTRACT

A combustor liner (231) for a gas turbine engine combustor (200) comprises an inner wall (232), an outer wall (238), a flow channel (244) formed there between, and an end-capping ring (246). The end-capping ring (246) is sealingly attached to the downstream end of the inner wall (232). In operation air passes within the end-capping ring (246), into the flow channel (244), and through holes (250) disposed in the inner wall (232). In some embodiments, an end-capping ring variation, a flow-diverting ring (357) comprises a plurality of holes (360) that, during gas turbine engine operation, may additionally dispense a flow of cooling air. One or more surfaces may be coated with a thermal barrier coating (237) to provide additional protection from thermal damage.

13 Claims, 6 Drawing Sheets

COMBUSTOR LINER WITH REVERSE FLOW FOR GAS TURBINE ENGINE

FIELD OF THE INVENTION

The invention generally relates to a gas turbine engine, and more particularly to the combustor liner of such an engine.

BACKGROUND OF THE INVENTION

In gas turbine engines, air is compressed at an initial stage, then is heated in combustors, and the hot gas so produced drives a turbine that does work, including rotating the air compressor.

Components along and near the flow of hot gases in a turbine are subject to degradation based on their exposure to relatively high combustion gas temperatures. Among these components are combustor liners, which help define a passage for combusting hot gases immediately downstream of swirler assemblies in a gas turbine engine combustor. The surfaces of combustor liners are subject to direct exposure to the combustion flames in a combustor, and are among the components that are in need of cooling in various gas turbine engines.

An effusion type of open cooling has been utilized to cool combustor liners. This generally is depicted in FIG. 1A, which provides a cross-sectional lateral view of a prior art combustor 100. A predominant airflow (shown by thick arrows) passes along the outside of combustor 100 and into an intake 102 of the combustor 100. Centrally disposed in the combustor 100 is a pilot swirler assembly 104, and disposed circumferentially about the pilot swirler assembly 104 are a plurality of main swirler assemblies 106. Combustion in this major flow of air and fuel generally takes place somewhat downstream of the pilot swirler assembly 104, designated in FIG. 1A as combustion zone 108. A transversely disposed base plate 110 is positioned near and may receive the downstream ends of the main swirler assemblies 106. An outlet 111 at the downstream end passes combusting and combusted gases to a transition (not shown, see FIG. 4).

Surrounding the combustion zone 108 is an annular effusion liner 112, and further outboard is a cylindrical frame 114. Welded to the frame 114 at its downstream end is an assembly of spring clips 116, which contacts a transition ring 120 of a transition (not shown in FIG. 1A). A plurality of holes (not shown) in the frame 114 allows passage of a quantity of air (shown by narrow arrows) that may pass through spaced apart effusion holes (not shown in FIG. 1A) in the effusion liner 112. FIG. 1B provides an enlarged view of the encircled section of FIG. 1A, in which spaced apart effusion holes 122 are depicted. The passage of air through the effusion holes 122 provides for a cooling of the effusion liner 112.

Referring to FIG. 1B, passage of air also is designed to occur along a radial gap 125 between the respective downstream ends 113 and 115 of the effusion liner 112 and the frame 114. The gap 125 is required to accommodate axial and radial differential expansion between the effusion liner 112 and the frame 114, and air flowing through the gap 125 also provides a cooling effect for the end of the effusion liner 112 and the frame 114. In certain embodiments a plurality of spaced apart protrusions 116 disposed at or near the end 113 of the effusion liner 112 establish the radial height of the gap 125.

Based on observation and analysis of present systems, such as that described in FIGS. 1A and 1B, and potential problems in some units of such systems, there is a need for an improved combustor liner that overcomes such problems.

BRIEF DESCRIPTION OF THE DRAWINGS

Aspects of the invention are explained in following description in view of drawings that are briefly described below.

DETAILED DESCRIPTION OF THE INVENTION

Embodiments of the present invention provide for uniformly controlled cooling of a double-walled combustor liner that is effective to predictably and consistently provide cooling air currents to such liners. Advantageously, the relatively more upstream position at which cooling air enters the major flow of air and fuel results in relatively more effective dilution of combusting gases by increasing the total mass proportionally.

This dilution results in a lowering of the maximum combustion temperature, which thereby lowers the production of $NO_R$. Thus, the embodiments of the present invention are effective both for cooling the combustor liner and also for providing a mass-diluting airflow into the hot gas stream sufficiently upstream to effectuate a lowering of the $NO_R$. The sole or primary cooling airflow of the double-walled combustor liner comprises a reverse-flow aspect through a channel defined by an inner and an outer wall of the combustion liner. Thus, the present invention in its various embodiments provides an advanced approach to cooling the combustion chamber liner while lowering $NO_R$.

Figure 1A:
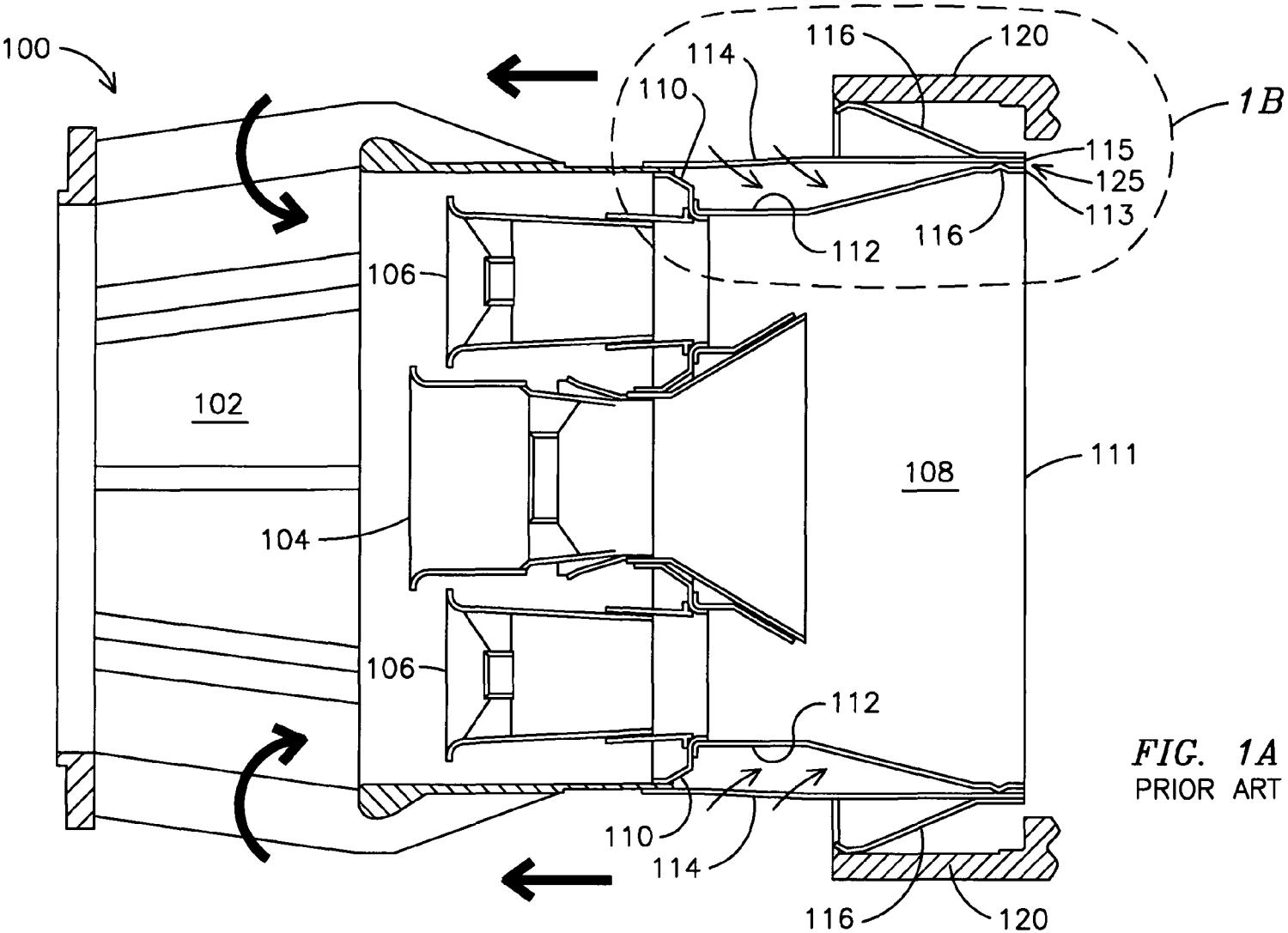
FIG. 1A PRIOR ART
FIG. 1A is a lateral cross-sectional view of a prior art combustor comprising an effusion-type combustor liner.
Figure 1B:
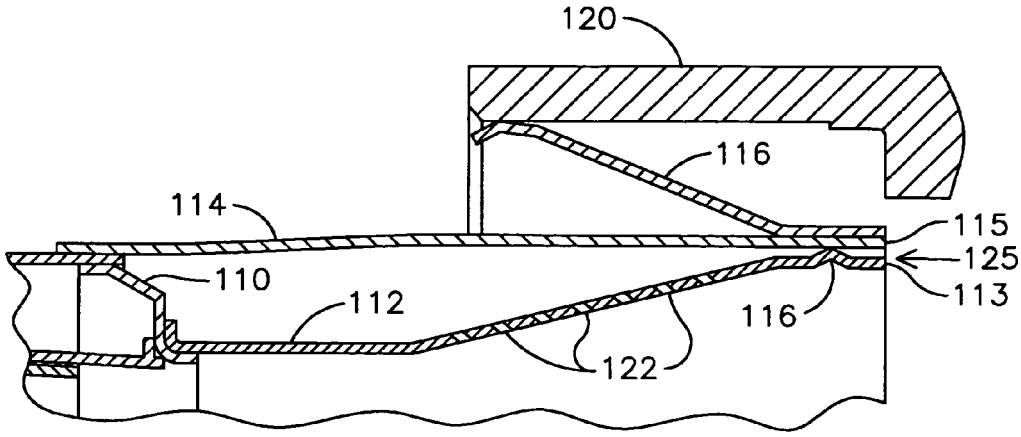
FIG. 1B PRIOR ART
FIG. 1B provides an enlarged view of an encircled portion of the prior art combustor depicted in FIG. 1A.

The present invention was created as a result of first identifying potential problems with presently used liner systems in gas turbine combustors. For example, referring to FIG. 1B, it has been appreciated that the radial gap 125 may at times allow excessive airflow and/or provide an uneven airflow, either of which are hypothesized to have the potential to lead to lower gas turbine engine performance. Factors affecting the size and non-uniformity of the gap 125 may include: 1) in-tolerance 'mismatches' in which respective ends 113 and 115 of the effusion liner 112 and the frame 114 are within their respective tolerances, but at extreme ends of the respective in-tolerance ranges (i.e., end 113 at lower end, end 115 at upper end); 2) thermal expansion; 3) out of round condition of the effusion liner 112 and/or the frame 114; and 4) a permanent set in the effusion liner 112 and/or the frame 114, such as due to creep or plastic deformation caused by thermally induced stresses. It is appreciated that the performance of individual units may vary depending on the effect of one or more of these factors, and this may lead to variability in performance among the different combustors in a particular gas turbine engine (such as a can-annular style). In addition to such potentially adverse performance, such variability is hypothesized make less clear the diagnosis of other issues.

Based on such appreciation of potential air leakage and unequal passage of cooling air with existing combustor liner designs, a new liner is developed. This development is directed to overcome gap variation and consequent performance imbalances hypothesized to affect some combustor units. The new liner comprises an inner annular wall the inside surface of which is directly exposed to the combustion zone, an outer annular wall, spaced from the inner annular wall, defining a flow channel there between for passage of a cooling airflow. A relatively upstream region of the outer wall sealingly connects to the inner wall, while a downstream end of the outer wall defines a free edge around which cooling air may flow to enter the flow channel. Further as to the latter, an end-capping ring with an upstream open end partially encloses the downstream end free edge and helps form a flow path leading to the flow channel. The space between the end-capping ring and the outer wall downstream end may be referred to as an annular flow-reversing channel. This is because in this space cooling airflow that enters from outside the combustion chamber reverses flow direction to thereafter flow upstream in the flow channel, and then through holes provided in the inner wall.

More to the latter aspect, a plurality of holes are provided through the inner wall, at a physical upstream end of the flow channel (which for purposes herein is the flow-based downstream end of the flow channel). A cooling airflow from the flow channel passes through this plurality of holes to join the major flow of air and fuel in the combustion chamber. This provides the aforementioned dilution effect. As used with regard to the end-capping ring variants that comprise holes, and any other components of the present invention, the term "hole" is not meant to be limited to a round aperture through a body as is illustrated in the embodiment depicted in the figures. Rather, the term "hole" is taken to mean any defined aperture through a body, including but not limited to a slit, a slot, a gap, a groove, and a scoop.

Further, the liner structure eliminates the above-described gap between prior art liner and frame ends through which, it is hypothesized, air may flow unevenly and wastefully. In contrast, the present invention comprises an annularly shaped end-capping ring at the downstream end of the combustion chamber that is sealing connected to adjacent components (or in some embodiments may be integral with such adjacent functional components). Also, the flow channel is in fluid communication with the spaced apart holes provided through the inner wall, at an upstream end of the flow channel. It is noted that this plurality of holes, in various embodiments, are positioned sufficiently upstream in relation to the combustion zone within the combustion chamber so that the cooling air is effective to dilute the mass of the combusting gases to lower the maximum combustion temperature and thereby lower the $NO_R$. That is, in various embodiments the cooling airflow through the flow channel enters the major flow of air and fuel in the combustion chamber at a point sufficiently upstream to provide an effective dilution of combustion to decrease the maximum attained combustion temperature, thereby lowering $NO_R$.

Further as to temperature management, in certain embodiments a portion of the inner surface of the inner annular wall comprises a Thermal Barrier Coating ("TBC"), such as a ceramic coating, that provides enhanced thermal protection to this portion. Other aspects of the invention are disclosed during and after discussion of specific embodiments provided in the appended figures.

Figure 2A:
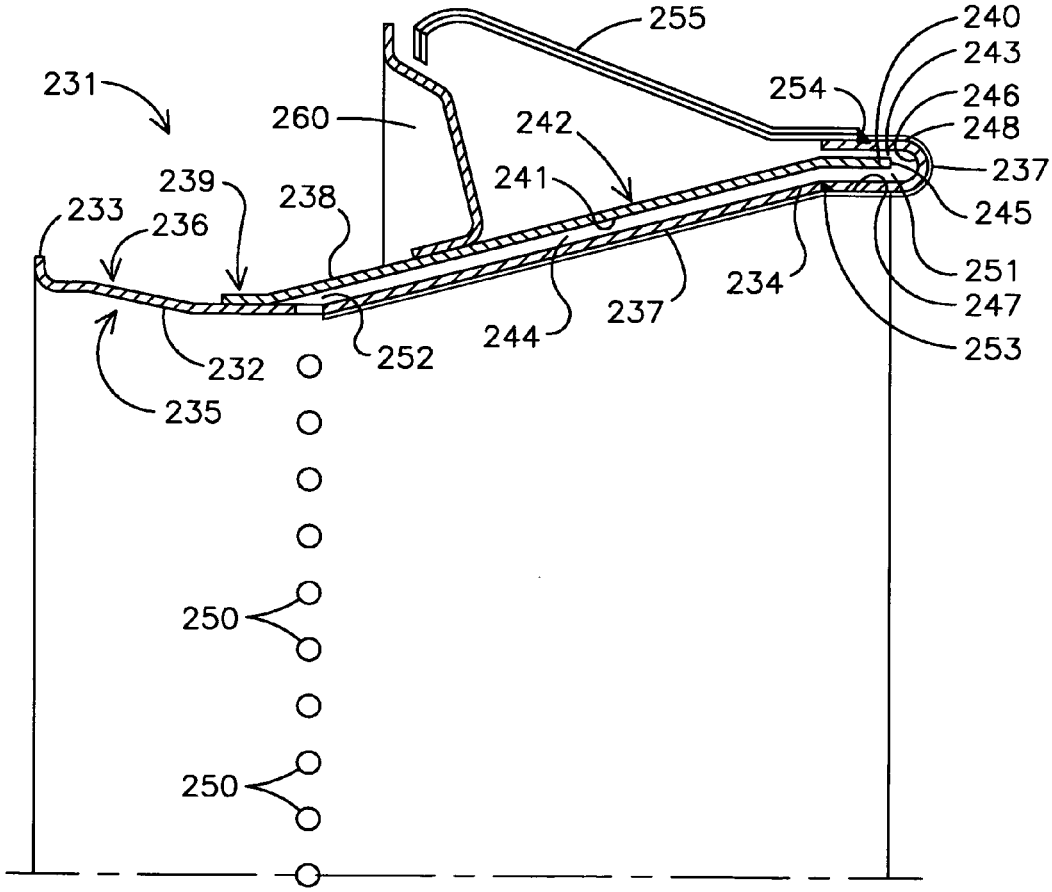
FIG. 2A provides a partial lateral cross-sectional view of one embodiment of a combustor liner of the present invention, with two components attached to the combustor liner.

FIG. 2A depicts an exemplary embodiment of a new liner 231. Liner 231 comprises an inner wall 232, an outer wall 238, a flow channel 244 formed there between, and an end-capping ring 246. The inner wall 232 of liner 231 comprises an upstream end 233, a downstream end 234, welded to the end-capping ring 246, an inner surface 235, and an outer surface 236. The outer wall 238 comprises an upstream end 239, a downstream end 240, ending with a free edge 245, an inner surface 241, and an outer surface 242. The flow channel 244 is annular and has a length defined from the upstream end 239 to the downstream end 240 of outer wall 238, and a width defined as the distance between the inner wall 232 outer surface 236 and the opposing inner surface 241 of the outer wall 238. Considering flow direction during normal operations, the flow channel 244 has a flow-based upstream end 251 and a flow-based downstream end 252. The remaining space (more upstream from upstream end 251 with regard to flow during operation) between the end-capping ring 246 and the outer wall downstream end 240 may be referred to as an annular flow-reversing channel 243.

In the depicted embodiment, a major portion, meaning more than 50 percent, of the inner surface 235 is coated with a thermal barrier coating 237. Other embodiments may comprise no thermal barrier coating, a total coverage with a thermal barrier coating, or a smaller percentage coverage with a thermal barrier coating.

The downstream end 234 of inner wall 232 is welded to an inboard region 247 of the end-capping ring 246. In FIG. 2A the entire outer surface of the end-capping ring 246 is shown as coated with thermal barrier coating 237, except for the most upstream portion of an outboard region 248 at which there is an attachment of a spring clip assembly 255. Neither the presence of the thermal barrier coating 237, nor the attachment of the spring clip assembly 255 to the end-capping ring 246, is meant to be limiting of the scope of the present invention.

The separation between the inner wall 232 and the outer wall 238 may be established by any spacing means (not shown) as is known to those skilled in the art. Structures generally known "stand-offs," which may be stretch formed, such as stretch-formed dimples, may be provided at spaced intervals to establish a desired space between the inner wall 232 and outer wall 238. Other forms of stand-offs, or spacers, to provide a minimum or desired distance between the walls, are well known in the art.

While not meant to be limiting of the scope of the present invention, in the embodiment depicted in FIG. 2A a barrier structure 260 is attached, such as by welding, to the outside surface 242 of outer wall 238. The barrier structure 260 limits movement of broken-off spring clips (not shown in FIG. 2A), and is described in greater detail in U.S. patent application Ser. No. 11/117,051, which is incorporated by reference herein for such teachings. More generally, this and all other patents, patent applications, patent publications, and other publications referenced herein are hereby incorporated by reference in this application in order to more fully describe the state of the art to which the present invention pertains, to provide such teachings as are generally known to those skilled in the art, and to provide specific teachings as may be noted herein. Also, it is recognized that a spring clip assembly is but one type of seal that may be provided between a combustor and a transition of a gas turbine engine, and the discussion and the depiction of a spring clip assembly herein is not meant to be limiting to the scope of the invention as claimed herein.

Figure 2B:
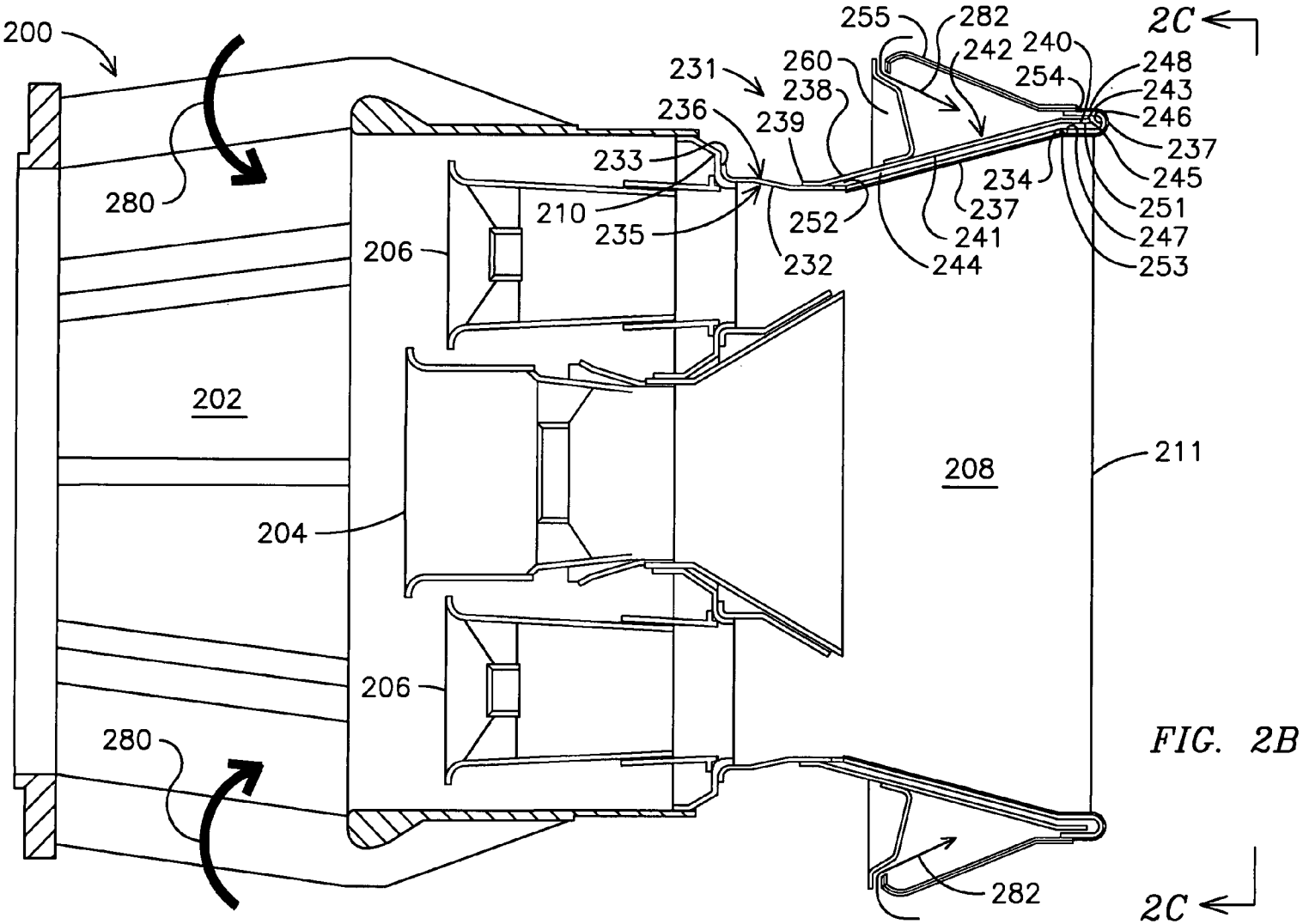
FIG. 2B provides a lateral cross-sectional view of a combustor comprising the combustor liner of FIG. 2A.

FIG. 2B depicts a combustor 200 in cross-section, comprising the liner 231 of FIG. 2A. In addition to the liner 231, combustor 200 comprises standard combustor components that include an intake 202, a centrally disposed pilot fuel swirler assembly 204, a plurality of main swirler assemblies 206, a base plate 210, and an outlet 211. A combustion zone is indicated by 208, although it is appreciated that a percentage of combustion may actually occur further downstream, in the transition (not shown). It is noted that for embodiment depicted in FIGS. 2A and 2B, no component corresponds exactly to the cylindrical frame 114 in FIG. 1A. As an alternative, the liner 231 may be constructed of sufficiently strong material to support the spring clip assembly 255 and forces transmitted through this structure. For example, not meant to be limiting, the thickness of the inner wall 232 may be about 0.090 inches, rather than a more commonly used 0.060 inches thickness. As a further example, not to be limiting, the outer wall 238 may have a thickness of about 0.060 inches, and a representative embodiment may have a channel height (i.e., distance between the inner and outer walls of flow channel 244) of about 0.080 inches. As viewable in FIG. 2B, the upstream end 233 of the inner wall 232 is shown welded to a curved section of base plate 210. This provides for structural integrity and transfer of forces between the spring clip assembly 255 and the combustor 200. However, this arrangement is not meant to be limiting.

Further to the thermal barrier coating 237, as depicted in FIGS. 2A and 2B, the thermal barrier coating 237 covers not only a major portion of the inner surface 235 of the inner wall 232, but also covers most of the end-capping ring 246. A thermal barrier coating such as 237 may be comprised of any suitable composition recognized to provide an effective thermal barrier in the operating temperature range of the combustion zone 208. A ceramic coating may be used, for example. This would be applied over the surface of the material of the inner wall 232 after suitable surface preparation. It is noted that the composition of the inner wall 232, the outer wall 238, and the end-capping ring 246 may be a nickel-chromium-iron-molybdenum alloy (e.g. HASTELLOY® X alloy), an alloy known to those skilled in the art of gas turbine engine construction. Other metal alloys known to those skilled in the art, or other non-metallic materials, may alternatively be utilized.

Figure 2C:
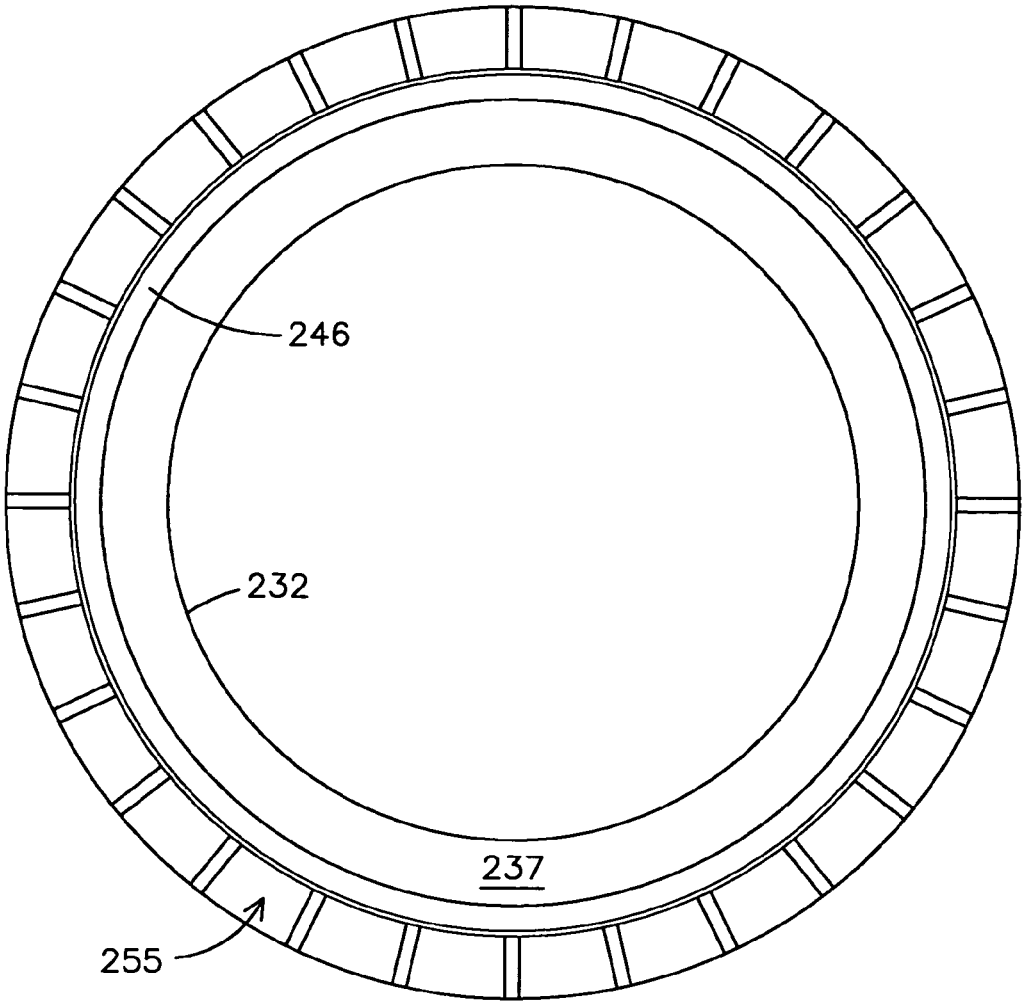
FIG. 2C is a cross-sectional view taken along the line 2C-2C of FIG. 2B, illustrating the end-capping ring in relation to other components.

FIG. 2C provides an upstream view from line 2C-2C of FIG. 2B, and depicts the inner wall 232 coated with thermal barrier coating 237, the end-capping ring 246, and the spring clip assembly 255. Also, as depicted in FIG. 2B, in various embodiments the inboard region 247 and the outboard region 248 of the end-capping ring 246 comprise respective weld preps (indicated as 253 and 254 in FIG. 2A) that may respectively provide for stronger weld bonds with the adjoining regions of the inner wall 232 and the spring clips 255. Although not considered the best mode, considering current materials and forming techniques, it is nonetheless considered within the scope of the present invention that certain embodiments may provide a unitary structure encompassing the functional and physical aspects of both the inner wall 232 and the end-capping ring 246.

In the embodiment depicted in FIGS. 2A-2C, the major flow of air from the compressor (not shown) is indicated by bold arrows 280, while a lesser volume of such air passes along the path indicated by arrows 282 to enter flow channel 244. Thus, a cooling airflow supplied by the gas turbine engine compressor (not shown in these figures, see FIG. 3) enters the flow channel 244 after reversing direction in the flow-reversing channel 243 that is formed between the downstream end 240 of the outer wall 238 and portions of the end-capping ring 246 (i.e., the outboard region 248 and a region downstream of the outer wall free edge 245). The cooling air then travels upstream toward and then through the holes 250 that are positioned in the inner wall 232 at the upstream end of the flow channel 244. This flow of cooling air through the holes 250 is effective to control the cooling airflow, and to provide convective cooling along the inner wall 232. By control, as that term is used herein with regard to the holes 250 is not an active form of control. Rather the control of cooling airflow is a function of a predetermined cross-sectional flow area that does not change in order to effectuate the desired control. The predetermined cross-sectional flow area, and the size, shape, and distribution of holes 250 in the inner wall 232 are determined as a function of the calculated or modeled flow to achieve a desired level of cooling under varying operating conditions, and may vary from embodiment to embodiment depending on factors that include the presence of a thermal barrier coating on the inner wall 232. Additionally, these parameters may be calculated or otherwise determined for achieving desired levels both of cooling and of $NO_x$ reduction. Such determination may be by calculation, modeling, or ongoing improvement programs based on data collection of actual operation gas turbine engines.

Further, because the holes 250 provide the only defined exits for such cooling airflow, when embodiments such as that depicted in FIGS. 2A-2C are installed in a plurality of combustors in a gas turbine engine, these embodiments are effective to provide a uniformly controlled open cooling of the combustor liner walls. This uniformity contrasts with the less controllable prior art embodiments that may be subject to the aforementioned sources of variability. It is appreciated that this provision of a uniformly controlled open cooling, or alternatively, the property of being effective to control a particular cooling airflow, is based on a passive control, related in part to the size, number and distribution of holes in inner wall 232, rather than to an 'active' type of control.

Figure 3A:
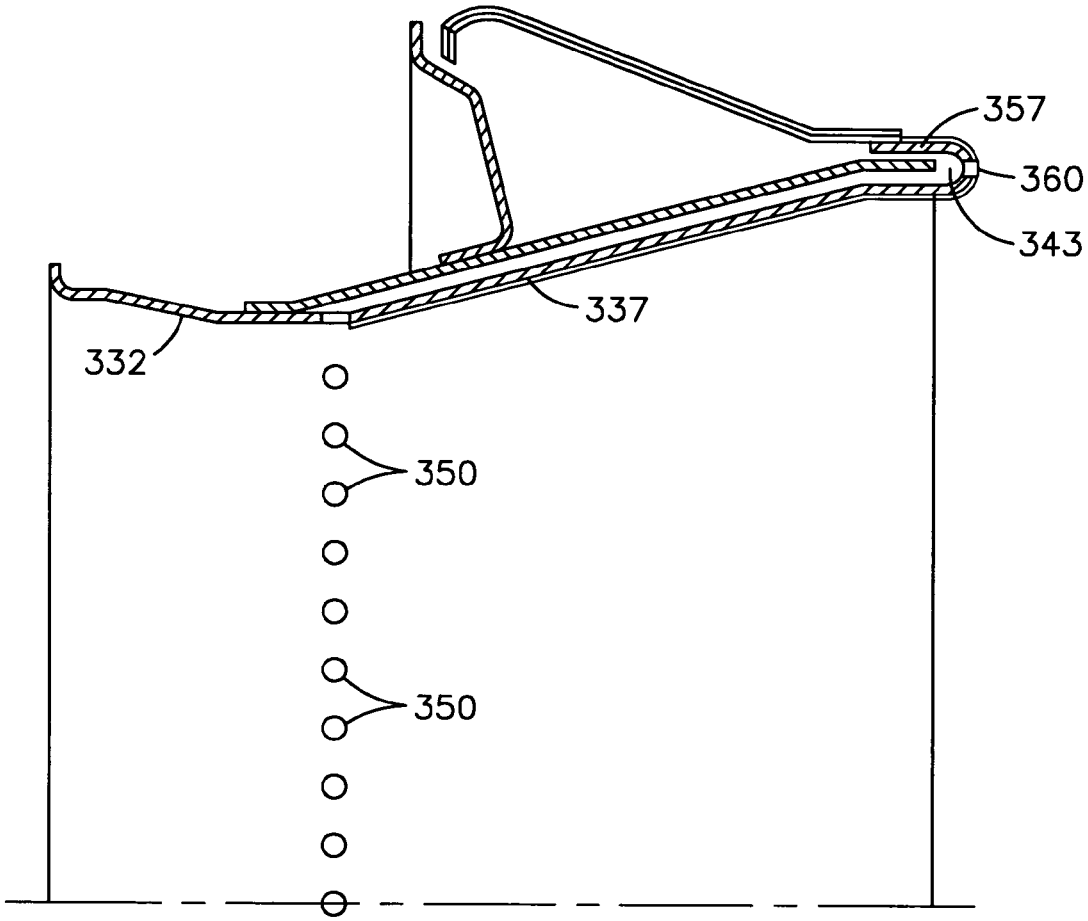
FIG. 3A provides a partial lateral cross-sectional view of another embodiment of a combustor liner of the present invention, comprising a flow-diverting ring comprising holes.

Embodiments also may provide a flow of cooling air through holes in a modified end-capping ring, that flow being in addition to the flow through more upstream disposed holes in the inner wall, those latter holes communicating with the channel between the outer wall and a corresponding downstream portion of the inner wall. FIGS. 3A and 3C provide an exemplary depiction of one of such embodiments. A flow-diverting ring 357, which may be considered a variant of the broader term end-capping ring, has previously described attributes of the end-capping ring of FIGS. 2A-2C, and also comprises a plurality of spaced-apart holes 360 (only one shown in FIG. 3A) through which cooling air may flow from an annular flow-reversing channel 343. In various specific embodiments, the proportion of the total volume of cooling air that enters the flow-reversing channel 343 which flows through the plurality of holes 360 is small relative to the proportion of such total entering cooling air that flows through the holes 350 in inner wall 332. Generally, when holes such as 360 are provided in an embodiment, the majority of airflow entering the end-capping ring nonetheless continues through the flow channel between the inner and outer walls and out the plurality of holes (i.e., 250 of FIG. 2A) in the inner wall. Referring again to FIG. 3A, a portion of inner wall 332 is covered with an optional thermal barrier coating 337.

Figure 3B:
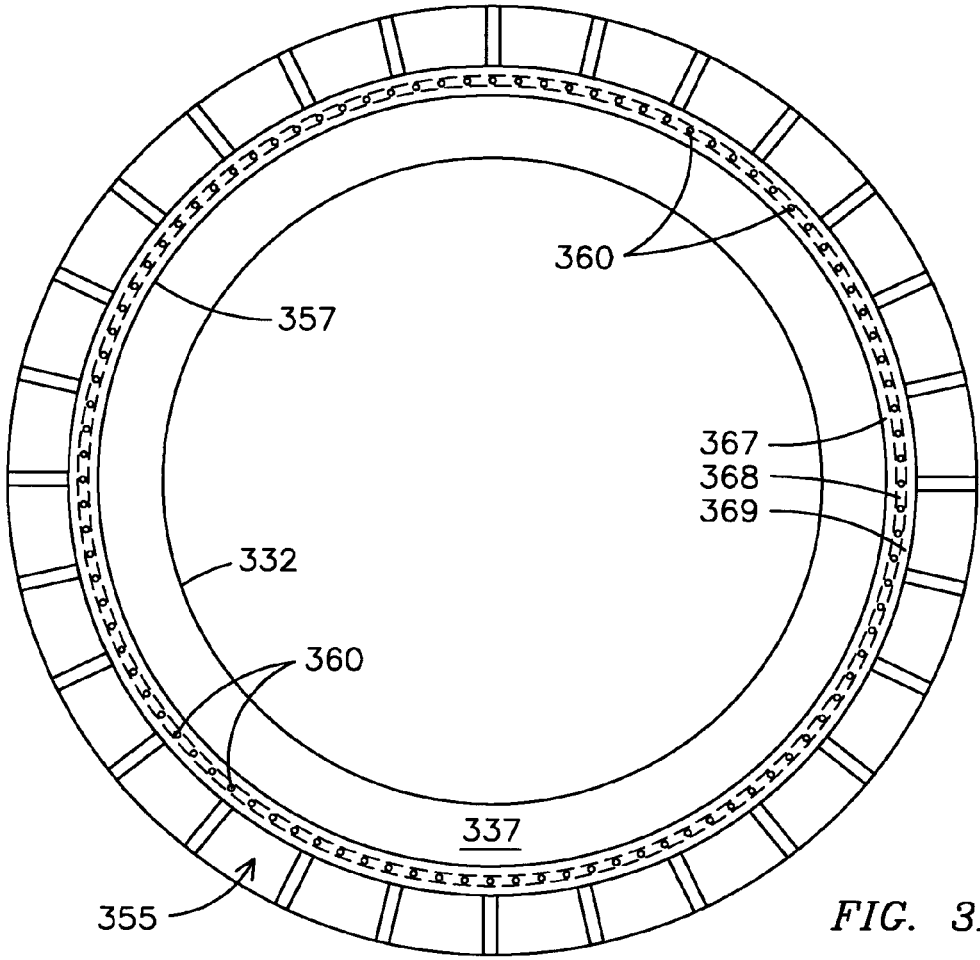
FIG. 3B provides a cross-sectional view of a combustor comprising the embodiment of FIG. 3A, taken along a line analogous with the line for FIG. 2C.

The flow of cooling air passing through holes 360 in the flow diverting ring 357 may be provided to augment cooling of this downstream component the positioning of which generally exposes it to relatively high temperatures in need of additional cooling. This cooling augmentation may occur by providing a uniform and spaced flow of cooling air through the holes 360. It is noted that the cooling air exiting the holes 360 are in fluid communication with the combustion zone 308, albeit the holes 360 literally provide air into the transition at the juncture of the combustor (not shown in its entirety, see FIGS. 2B and 4) and the transition (not shown, see FIG. 4). FIG. 3B provides a cross-sectional view, similar to FIG. 2C, however depicting aspects of the flow-diverting ring 357 depicted in side view in FIG. 3A. The flow-diverting ring 357 may generally be considered to comprise an inboard region 367 disposed inboard of a central region 368 that comprises a plurality of the holes 360, and an outboard region 369 disposed outboard of the central region 368. Also depicted in this view are a portion of the inner wall 332 (the holes 350 not being in view), that portion being covered with the optional thermal barrier coating 337, and spring clips 355.

As for the embodiment depicted in FIGS. 2A-2C, for embodiments such as depicted in FIGS. 3A-3B a predetermined cross-sectional flow area, and the size, shape, and distribution of holes 250 in the inner wall 232 are determined as a function of the calculated or modeled flow to achieve a desired level of cooling under varying operating conditions, however also taking into consideration the desired flow and corresponding predetermined cross-sectional flow area, and the size, shape, and distribution of holes 360 in the flow-diverting ring 357. Thus, for such embodiments, there may be provided a desired balancing of cooling flows from these two outlet sources for cooling fluid. The balance may vary from embodiment to embodiment depending on factors that include the presence of a thermal barrier coating on the inner wall 332.

Also, although the inner wall 332 and the outer wall 338 are depicted in FIGS. 3A and 3B as parallel, this is not meant to be limiting. For instance, the spacing between an inner wall and an outer wall may decrease (or may increase) from upstream to downstream ends of a flow channel formed between such walls.

Figure 4:
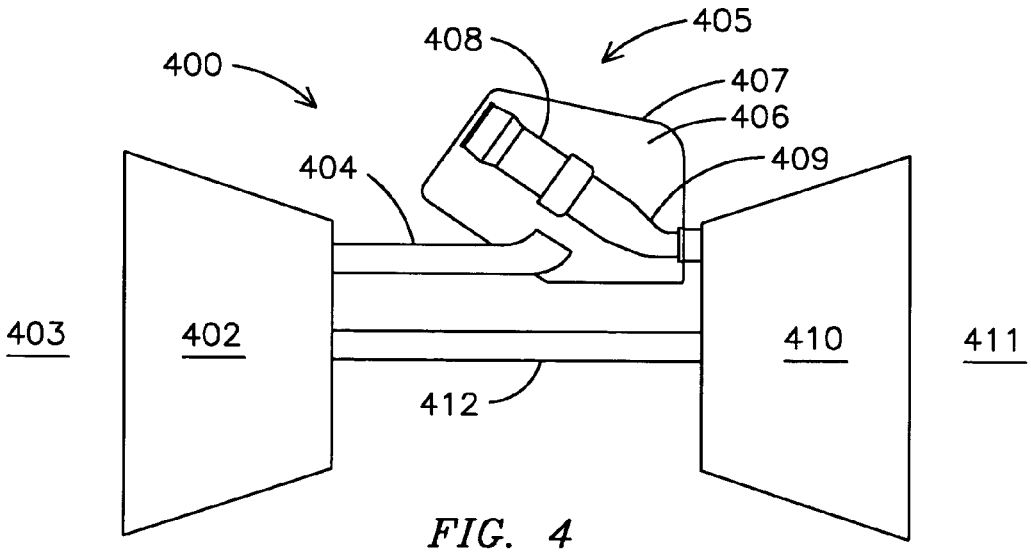
FIG. 4 is a schematic lateral cross-sectional depiction of a gas turbine showing major components, in which embodiments of the present invention may be utilized.

Embodiments of the present invention are used in gas turbine engines such as are represented by FIG. 4, which is a schematic lateral cross-sectional depiction of a prior art gas turbine 400 showing major components. Gas turbine engine 400 comprises a compressor 402 at a leading edge 403, a turbine 410 at a trailing edge 411 connected by shaft 412 to compressor 402, and a mid-frame section 405 disposed there between. The mid-frame section 405, defined in part by a casing 407 that encloses a plenum 406, comprises within the plenum 406 a combustor 408 (such as a can-annular combustor) and a transition 409. During operation, in axial flow series, compressor 402 takes in air and provides compressed air to an annular diffuser 404, which passes the compressed air to the plenum 406 through which the compressed air passes to the combustion chamber 408, which mixes the compressed air with fuel (not shown), providing combusted gases via the transition 409 to the turbine 410, whose rotation may be used to generate electricity. It is appreciated that the plenum 406 is an annular chamber that may hold a plurality of circumferentially spaced apart combustors 408, each associated with a downstream transition 409. Likewise the annular diffuser 404, which connects to but is not part of the mid-frame section 405, extends annularly about the shaft 412. Embodiments of the present invention may be incorporated into each combustor (such as 408) of a gas turbine engine to provide a more uniform and controlled open cooling of the combustor liner walls.

With or without an end-capping ring that comprises holes for passage of a cooling airflow (such as the flow-diverting ring discussed above), embodiments of the present invention are effective to provide a reverse-flow cooling of a downstream portion of the combustion chamber inner wall with a cooling airflow that enters the combustion chamber sufficiently upstream for its use in combustion.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

What is claimed is:

1. A combustor for a gas turbine engine comprising:

an intake, an outlet, and at least one swirler assembly disposed there between;

an inner wall partially defining a combustion zone, comprising an upstream end and a downstream end;

an outer wall disposed about the inner wall, comprising an upstream end sealingly connected to the inner wall, spaced a distance therefrom to define a flow channel for passage of a cooling airflow, the flow channel comprising a flow-based upstream end and a flow-based downstream end; and an end-capping ring sealingly connected to the inner wall proximate the outlet and upstream of the outer wall downstream end, extending around the downstream end of the outer wall, and terminating upstream of the outer wall downstream end and downstream of the outer wall upstream end, forming with said outer wall downstream end a flow-reversing channel communicating with the upstream end of the flow channel, wherein at the flow channel downstream end the inner wall comprises a plurality of holes in fluid communication with the flow channel and the combustion zone, and, wherein during operation the plurality of holes is effective to control the cooling airflow into the combustion zone; and wherein the end-capping ring supports by rigid attachment thereto a spring clip assembly extending radially outward; the spring clip defining an inlet for the cooling airflow.

2. The combustor of claim 1, additionally comprising a thermal barrier coating on a portion of an inner surface of the inner wall.

3. The combustor of claim 2, wherein the portion is a major portion of the Inner surface.

4. The combustor of claim 1, wherein the flow channel comprises a uniform width along its length.

5. The combustor of claim 4, wherein the end-capping ring comprises a weld prep along a surfaces for connecting to the inner wall, and the end-capping ring is sealingly connected to the inner wall by welding along the weld prep.

6. The combustor of claim 1, wherein the outer wall supports by rigid attachment thereto a cylindrical barrier structure formed to limit inward movement of the spring clip assembly and to restrict passage of spring clip fragments.

7. A gas turbine engine comprising the combustor of claim 1.

8. A combustor liner assembly for a gas turbine engine combustor comprising an outer wall at least partially disposed about an inner wall, forming a channel for passage of a cooling airflow between the inner wall and the outer wall, an end-capping ring sealingly connected to the inner wall proximate a downstream end of the outer wall upstream of the downstream end of the outer wall, the end-capping ring extending around a downstream end of the outer wall and terminating upstream of the outer wall downstream end and downstream of the outer wall upstream end to form a flow-reversing channel communicating with a flow-based upstream end of the flow channel, wherein at a flow-based downstream end of the channel the inner wall comprises a plurality of holes in fluid communication with the flow channel and the combustion zone; wherein the end-capping ring supports by rigid attachment thereto a spring clip assembly extending radially outward; the spring clip defining an inlet for the cooling airflow.

9. A gas turbine engine combustor comprising the combustor liner assembly of claim 8.

10. A gas turbine engine comprising the combustor of claim 9.

11. A gas turbine engine comprising a plurality of combustors disposed therein, each said combustor comprising:

an intake, an outlet, and at least one swirler assembly disposed there between;

an inner wall partially defining a combustion zone and an outer wall at least partially disposed about the inner wall to define there between a flow channel for passage of a cooling airflow; and an end-capping ring sealingly connected to the inner wall proximate the outlet and upstream of the outer wall downstream end, extending radially outwardly around a downstream end of the outer wall and terminating between the outer wall upstream and downstream ends to form a flow-reversing channel communicating with a flow-based upstream end of the flow channel, wherein at a flow-based downstream end of the channel the inner wall comprises a plurality of holes in fluid communication with the flow channel and the combustion zone; wherein the end-capping ring supports by rigid attachment thereto a spring clip assembly extending radially outward; the spring clip defining an inlet for the cooling airflow.

12. The gas turbine engine of claim 11, wherein collectively said plurality of holes in the respective inner walls are sized so as to be effective to provide a uniformly controlled cooling among each respective combustor liner wall.

13. The gas turbine engine of claim 11, wherein determined cross-sectional flow area, size, shape, and distribution of the holes are effective for achieving desired levels of cooling and NOx reduction.

* * * * *